US005365633A

United States Patent [19]

Sunagawa et al.

[11] Patent Number: 5,365,633

[45] Date of Patent: Nov. 22, 1994

[54] VACUUM CLEANER

[75] Inventors: Masao Sunagawa, Mito; Yukiji Iwase, Ushiku; Shigenori Sato, Chiyoda, all of Japan

[73] Assignee: Hitachi, Ltd., Tokyo, Japan

[21] Appl. No.: 687,016

[22] Filed: Apr. 18, 1991

[30] Foreign Application Priority Data

Apr. 18, 1990 [JP] Japan ..... 2-100324

[51] Int. Cl.[5] ..... A47L 9/00

[52] U.S. Cl. ..... 15/326; 15/412; 55/276; 417/312

[58] Field of Search ..... 15/326, 412; 55/276; 417/312

[56] References Cited

U.S. PATENT DOCUMENTS

| | | | |
|---|---|---|---|
| 3,874,023 | 4/1975 | Tschudy | 15/326 |
| 4,330,899 | 5/1982 | Miller et al. | 15/326 |
| 4,435,877 | 3/1984 | Berfield | 15/326 |
| 4,665,581 | 5/1987 | Oberdorfer | 15/326 |

FOREIGN PATENT DOCUMENTS

| | | | |
|---|---|---|---|
| 41463 | 3/1977 | Japan | 15/326 |
| 113175 | 10/1978 | Japan | 15/326 |

*Primary Examiner*—Chris K. Moore

*Attorney, Agent, or Firm*—Antonelli, Terry, Stout & Kraus

[57] ABSTRACT

A vacuum cleaner including an electric blower disposed inside a generally cylindrical rigid blower casing positioned inside the vacuum cleaner body. The blower casing has a lining of sound absorbing material and is configured to cause a swirling flow around inside the casing to an exit opening into a smoothly-curved transfer passage which curves away from the blower casing with a non-radial flow direction. The transfer passage curves circumferentially and axially and opens into an annular noise reduction space at the bottom of the cleaner body in which air is guided over a sound absorbing layer by smoothly arcuate guide ribs, vented through an aperture into an exhaust space between the bottom of the body and a caster base and escapes through a peripheral clearance around the caster base.

16 Claims, 5 Drawing Sheets

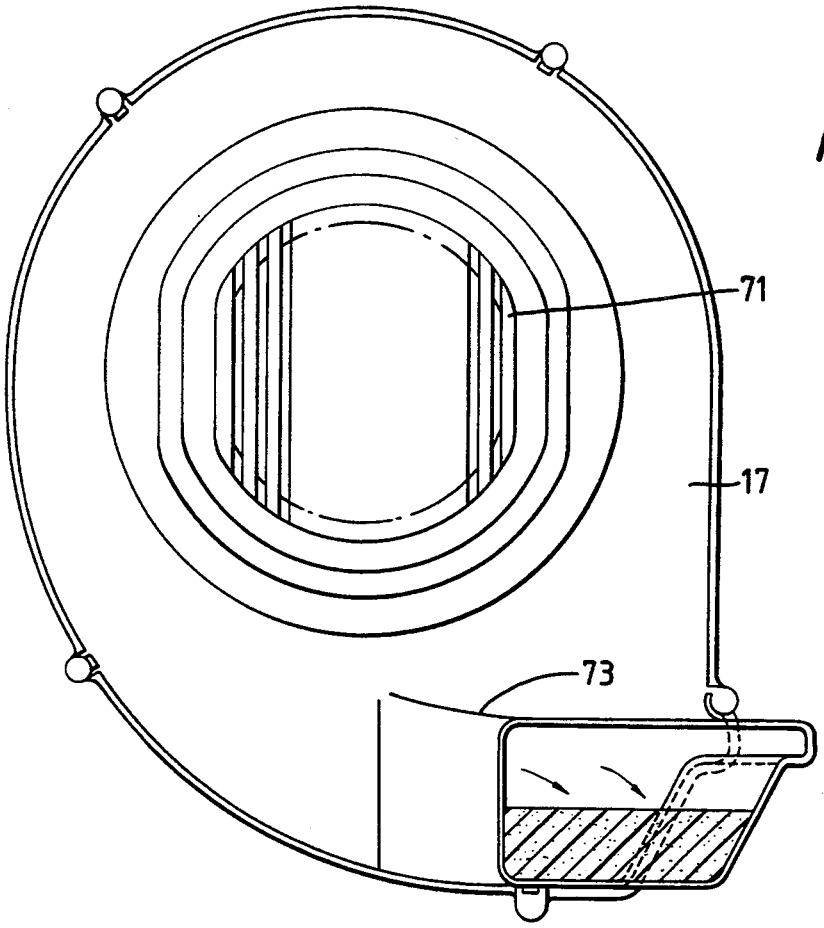
FIG. 4
FIG. 6
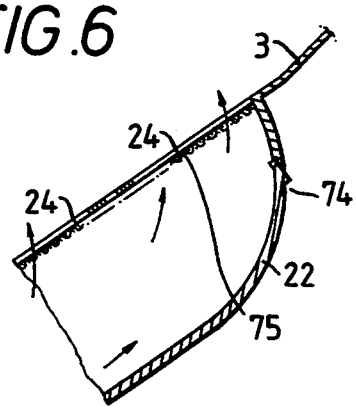

VACUUM CLEANER

FIELD OF THE INVENTION

This invention relates to vacuum cleaners, and more particularly to noise reducing means for vacuum cleaners.

BACKGROUND OF THE INVENTION

Generally in a vacuum cleaner the air on the blower side of the filter passes through the blower fan and radially outwardly through, for example window openings in the housing which forms part of the blower motor. Apart from noise made by the blower motor itself, passage of exhaust air from the blower motor housing to the one or more openings through which exhaust air escapes from the vacuum cleaner body contributes substantially to vacuum cleaner noise. In the prior art it has been to reduce the noise of exhaust air by causing the exhaust air to pass along a passage, or through a space, containing a sound absorbing material such as, for example, a polyurethane foam.

SUMMARY OF THE PRIOR ART

In, for example, Japanese Utility Model Laid-Open Publication 48-72753, a blower is axially horizontally mounted in a generally horizontal body, with a cylindrical tube encasing the motor housing so that the air escapes axially forwardly through an annular exit gap between the housing and the tube, with the tube being lined with foam. The escaping air collects in a cylindrical annular chamber between the casing and the vacuum cleaner outer body, also lined with foam, passes rearwardly down a foam-lined passage through a right-angled bend to an expansion space at a rear end of the vacuum cleaner; and then through low density foam and a grille to the exterior. Despite the sound absorbing material, the configuration of the exhaust part is such that the flow is repeatedly sharply bent and noise is generated.

In Japanese Utility Model Laid-Open Publication 48-84163, an axially upright-type cleaner is proposed wherein the blower is centrally vertically mounted in a generally cylindrical space defined by the main body casing. To create a long exhaust path-way, a sheet of sound absorbing foam material is wound in this space in a spiral form extending out from the blower to the casing. However, the main air flow velocity is concentrated along the outside of the path defined by the space, so the absorbing material along the inside is effectively wasted. Recently vacuum cleaner blower motors have become more powerful, which includes the problems associated with this type of construction.

In JP-A-61/179121 the exhaust is led directly from the blower through a foam layer and into a flattened chamber at the base of the casing. The chamber has U-shaped guide channels for guiding the air over a sound absorbing layer before passage into a rear expansion chamber and through a grille to the exterior.

SUMMARY OF THE INVENTION

It is an object of the present invention to provide a new construction for the escape of exhaust air in a vacuum cleaner which avoids, by simple means the problems existing in the prior art with respect to the exhaust air flow shortly after exiting the blower motor housing.

In accordance with advantageous features of the invention, a vacuum cleaner includes an electric blower surrounded within the vacuum cleaner body by a hard blower casing having a radially outwardly directed exit opening through which the exhaust air escapes from the casing to flow along a transfer passage in a curved path with a substantially non-radial directional component.

Advantageously, the interior of the casing is such so as to establish a swirling flow of the exhaust air, and, preferably the blower casing has a lining layer of a sound absorbing material such as, for example, a foam material. The disposition of sound absorbing material in the casing space may be used to establish the swirling flow.

Preferably the transfer passage curves away from the exit opening in a circumferential direction or component, and where there is swirling flow in the blower casing the sense of the opening should be aligned with the transfer passage direction.

Another possible directional component for the curved transfer passage is the axial direction (relative to the blower) preferably combined with a circumferential component. Desirably the air flow direction at the exit opening is curved through at least 45° in the circumferential direction and/or the axial sense. In the very restricted space normally available inside a vacuum cleaner body, this may direct the flow to a useful location with a useful flow direction for, for example, passage into further noise reduction means. It is particularly preferable that the transfer passage extends without any sharp angle to disrupt the flow. Desirably therefore it forms a smooth continuous curve. Normally it will not be necessary for the passage to curve through more than 100° from the initial flow direction at the exit opening, and, in fact, a transfer passage deviation of less than 90° will frequently be sufficient to bring the flow to a useful location.

In accordance with still further features of the present invention reflecting this special curving of the transfer flow, a vacuum cleaner is provided having a main body and an electric blower mounted within the main body, with an exhaust air pathway leading from the blower to an exterior of the main body in which the exhaust flow pathway comprises a casing space around the blower, with means for establishing an exhaust air flow in the casing space swirling circumferentially around the blower, and a transfer portion leading from the casing space with a gradually curving flow direction having a circumferential component following the direction of the circumferential swirl, and also an axial component relative to the blower to, for example, from a helical path.

An outer wall formed by the blower casing having, for example, a generally cylindrical form around the blower axis, may advantageously merge with an outer wall portion of the transfer passage in a substantially continuous curve. The transfer passage desirably contains a sound absorbing element, of, for example, foam material. This may be disposed as a wall lining in the passage as, for example, a lining along the outer wall portion of the passage curve.

Preferably, according to the present invention, the transfer passage opens into a noise reduction space before leaving the vacuum cleaner body. With the noise production space advantageously containing sound absorbing material such as, for example, foam. To achieve sound absorption over a large extent of space, without sharp corners in the flow, it is desirable that the noise reduction space occupy a substantial area in one plane. For example, the noise reduction space may be a chamber of a generally flattened shape in which the exhaust air is guided by at least one curved guide means in the space, and, preferably, a plurality of curved guide means defining channelled flow paths, over, for example, a layer of sound absorbing material.

Because of space restrictions in vacuum cleaner design, generally such a flattened chamber needs to extend transversely to the radial extent of the blower casing; across, for example, the bottom part of a vacuum cleaner body in which the blower casing is arranged axially horizontally arranged. The special transfer passage features described above may enable exhaust air to be introduced into such a space without any sharp corners after exiting the blower casing.

Such a noise reduction space provided at the bottom of the vacuum cleaner body may vent downwardly into a space defined between the bottom of the body and a runner base having mounted thereon such as, for example, means casters, whereby the vacuum cleaner may be easily moved across a floor. The runner base and cleaner body may be relatively rotatable. The exhaust air flow may escape from this exhaust space through a peripheral gap defined around the body between the runner base and body, thereby enabling a dispersion of the flow direction in many directions and assists in eliminating noise.

In accordance with still further features of the invention, a vacuum cleaner is provided wherein an electric blower is surrounded by a blower casing within the vacuum cleaner body, with a space between blower and casing for the passage of exhaust air from the blower, an exit opening in the blower casing opening into a transfer passage which leads, in turn, into a noise reduction space located adjacent the bottom of the vacuum cleaner body, having at least one arcuate guide and venting downwardly into an exhaust space below the body.

The blower casing of the vacuum cleaner may advantageously be formed in two separable parts, and the parts may advantageously define respectively opposing portions of the transfer passage. The preferred blower casing is a substantially rigid shell of, for example, material which may be lined e.g. with sound absorbing foam. The blower housing may be surrounded by an air permeable foam layer through which the exhaust air must pass, within the casing, to help reduce motor noise.

BRIEF DESCRIPTION OF THE DRAWINGS

Embodiments of the invention are now described by way of example, with reference to the accompanying drawings wherein

FIG. 4 is a front view of the blower casing of the vacuum cleaner of the present invention;

FIG. 6 is a vertical cross-sectional view taken along the line VI—VI in FIG. 5.

DETAILED DESCRIPTION OF THE PREFERRED EMBODIMENTS

Figure 1:
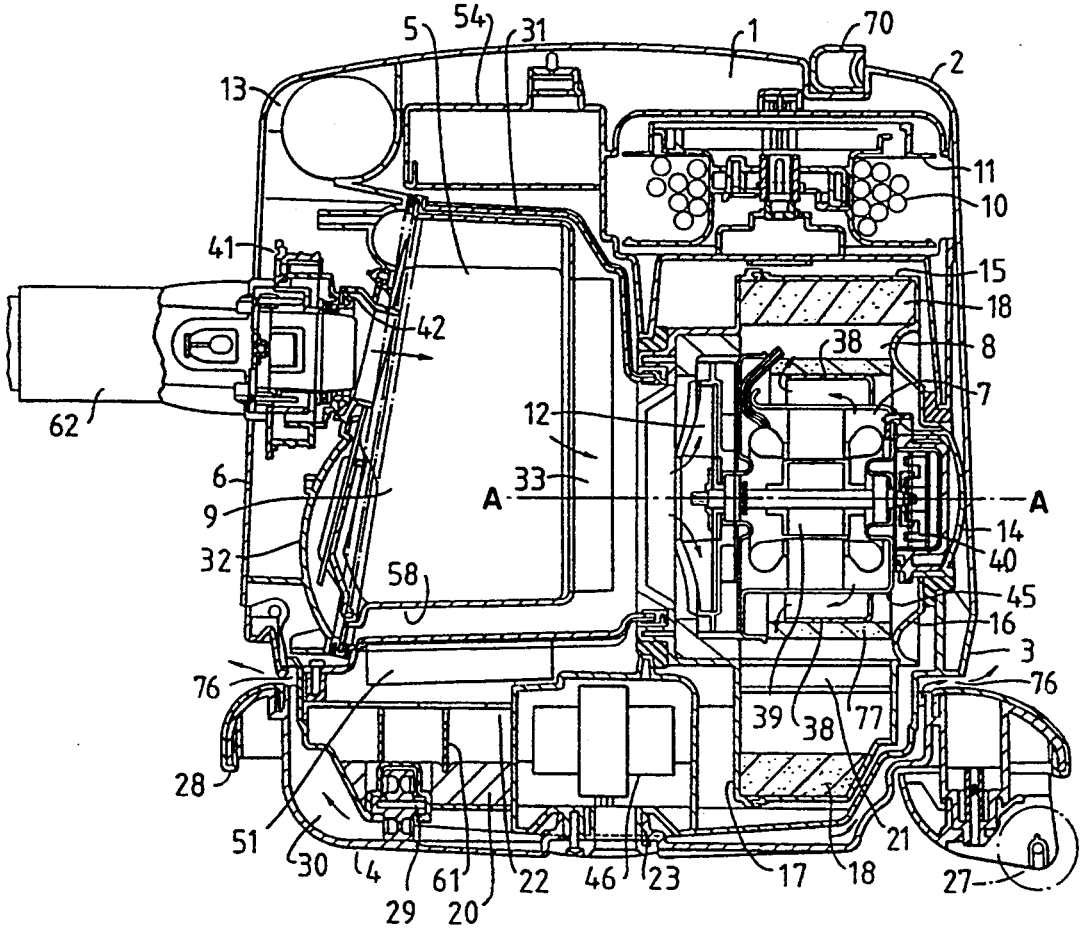
FIG. 1 is a median vertical cross-sectional view of a vacuum cleaner, passing through a blower axis.
Figure 2:
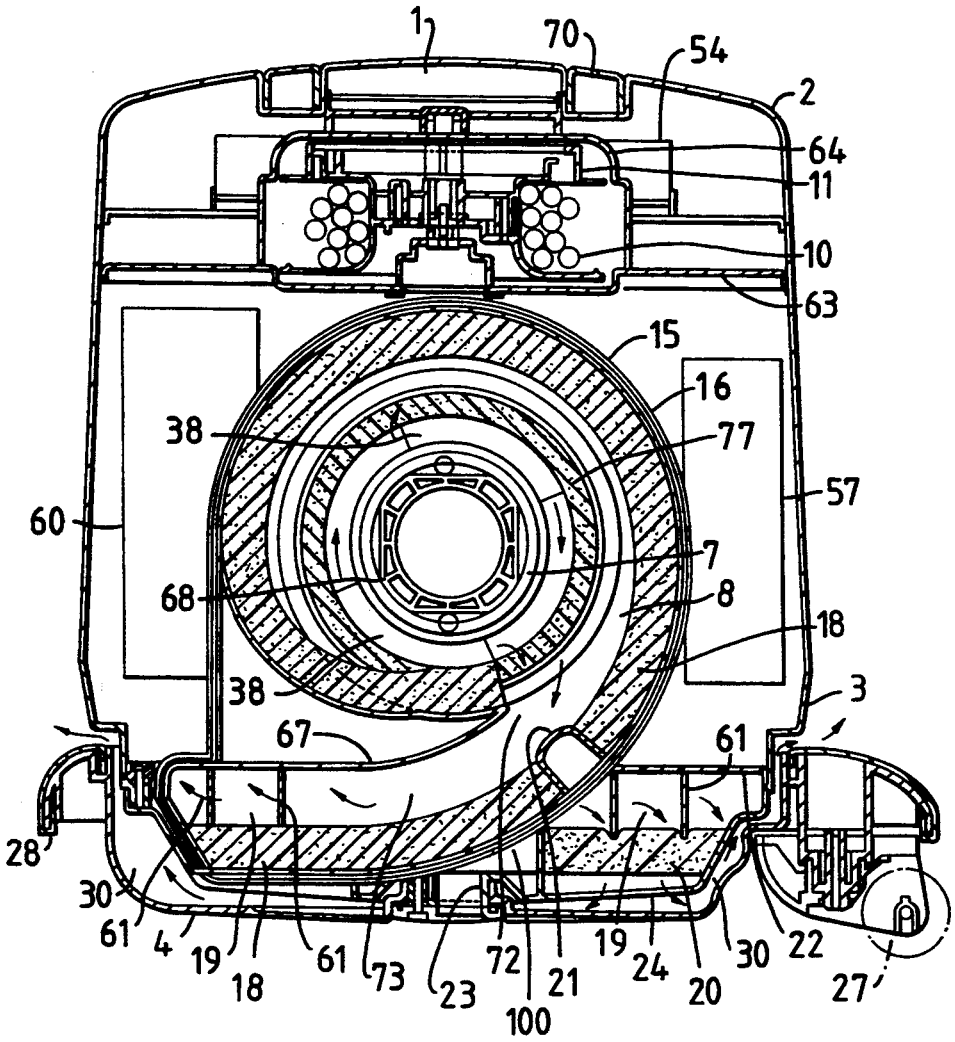
FIG. 2 is a vertical section transverse to that in FIG. 1, through the rear part of the vacuum cleaner of FIG. 1.
Figure 3:
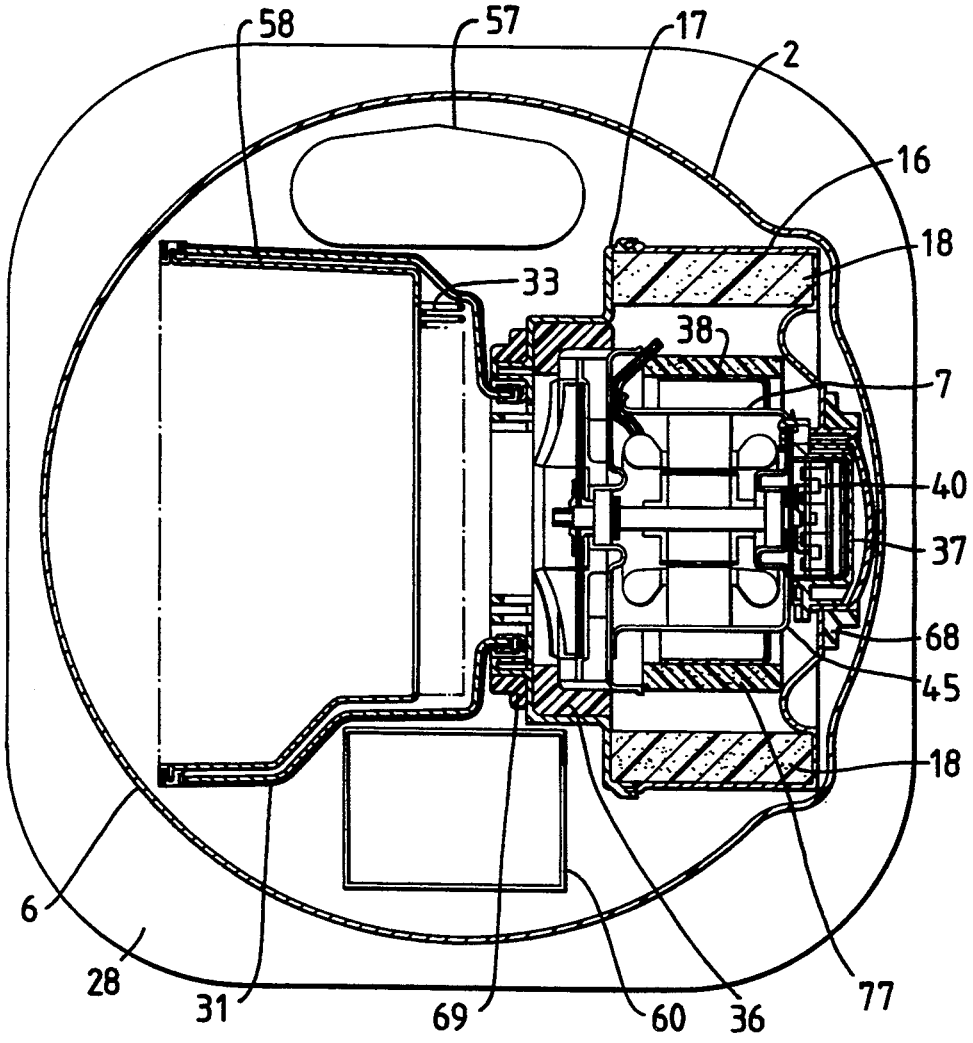
FIG. 3 is a horizontal cross-sectional top view, through the blower and dust collecting casing of the vacuum cleaner of the present invention.

Referring initially to FIGS. 1, 2 and 3, a vacuum cleaner of the "pot" type has a generally cylindrical axially upright body 1 including a generally cylindrical upper body portion 2, closed at its upper end and incorporating a carrying handle 70, and a lower body portion 3 closing off the bottom end of the upper portion 2. At a front side of the vacuum cleaner, the upper portion 2 includes an openable front cover 6 allowing access to a dust collecting chamber 9 incorporating a dust collecting filter 5. The dust collecting chamber 9 includes a generally cylindrical dust collecting casing 31 with a sealing inner cover 32 disposed inside the outer front cover 6 and having a hose socket 41 which receives, via a gas-tight packing 42, the end of a standard vacuum cleaner hose 62. Hose 62 is rotatably mounted, in a generally conventional way, in the socket 41 which is positioned inside the front cover 6. Inner cover 32 sealingly closes the front of a filter casing 58 containing a paper bag filter 5 which may be conventional.

Behind the casing of the filter 5, the dust collecting chamber 9 opens rearwardly into an enclosed blower compartment or air circulation space 8 through a microfilter 33 which retains any fine dust which might interfere with speed control 40 of the electric blower 7.

Above the blower compartment, in the top portion of the upright body 1, is an accessory compartment 13 accommodating a cord reel 11 for rewinding in a conventional manner an electric power supply cord 10 for supplying power to the blower. The compartment 13 also houses a control unit 54.

Metal casing 60 is disposed in the left-hand side of the body, to the side of the dust collecting casing 31, for accommodating electric parts such as, for example, a noise filter and a rectifier circuit, on a power source substrate. A metal casing 57 (FIGS. 2 and 3) is disposed to the right-hand side of the dust collecting chamber 31 for accommodating large capacitors, for power-factor improving and smoothing. An inverter circuit module 51 is attached to the bottom of the dust casing 31.

The vacuum cleaner is provided with a caster base 4, having peripheral casters 27 pivotally mounted thereon. The caster base is generally circular with an upturned peripheral portion having a bumper 28 for preventing furniture damage, and receives the bottom part 3 of the vacuum cleaner body 1. The lower body portion 3 is connected to the caster base 4 at a central axis by a rotation shaft 23 allowing the upright body 1 to be rotated without rotating the caster base 4. The lower body portion 3 also has a plurality of, for example, three or four running wheels 29 which roll on the inside of the upright caster base 4 so that the upright body 1 and caster base 4 rotate with an exhaust space 30 maintained between them. This exhaust space 30 forms a chamber of generally flattened shape with an upturned edge portion opening through an annular slot or gap 76 at the upper periphery of the caster base, defined on its inner side by the outwardly-facing surface of the lower body portion 3. The exhaust space 30 serves for exhaust discharge, as will be explained in detail below.

As shown in FIG. 4, the blower 7 includes a blower fan 12 disposed in the opening from the dust collecting chamber 9 and driven by an invertor-driven brushless electric motor 39. The motor and blower are; axially horizontally mounted in the blower compartment or air circulation space 8 which is within the upright body 1 at the rear thereof. The blower compartment or air circulation space 8 is defined by an electric blower casing of generally cylindrical form, with a front casing portion 17 (on the side of the fan 12) and a rear casing portion 16 separable from the front casing portion 17 to facilitate installation of the blower 7. Front casing portion 17 has a central intake hole protected by plastic ribs 71. The cylindrical side wall 15 of the casing is formed integrally, as part of the rear portion 16, with a spherically-curved central portion 14 of the rear wall of the casing, which gives the casing shell good rigidity and strength and in use reduces blower noises in the lower frequency range, of frequency below 1000 Hz. The cylindrical housing 45 of the blower motor 39 is positioned coaxially within the cylindrical wall of the casing formed by the rear and front casing portions 16, 17, with a substantial radial spacing between housing and casing wall. The housing 45 of the blower 7 includes openings so that exhaust air is blown radially outwardly from the blower 7, in a manner which may be conventional. In the illustrated embodiment, these openings are provided with forwardly-opening tail pipes 38 so that the air is blown out forwardly, e.g. in a direction along axis A—A toward the blower fan 12, along two 90° segments on opposite sides of the blower, as shown in FIG. 2. The tail pipes 38 may take other forms and, for example, have a radially outwardly directed blower opening or the tail pipes may be eliminated if desired.

Around the blower 7 outwardly adjacent the tail pipes 38, is a cylindrical air-permeable and flame-retardant cover 77 of, for example, a low-density polyurethane foam, through which the exhaust air must pass. The cylindrical cover 77 helps to reduce the risk of fire and also reduces motor noise while smoothing the exhaust air flow.

As shown in FIG. 2, the outer wall 15 of the blower casing is generally cylindrical at its upper portion. The outer wall 15 substantially thick, sound absorbing foam lining 18. A radial annular space is defined in the blower compartment or exhaust air circulation space between the sound absorbing foam lining 18 and the inner foam cover 77, in which exhaust air can circulate within the blower casing. At a lower left-hand portion (FIG. 2) the outer casing wall curves in more sharply to form a reduced radius portion in which the blower compartment or air circulation space 8 is substantially blocked off by the sound absorbing foam lining 18. At its lower right-hand portion, the outer wall 15 has an increase in curvature radius so as to extend away from the blower 7 and form an outer wall of an exhaust or transfer passage 73, having a generally rectangular cross-section, leading away from a substantially rectangular-section exit opening 72 penetrating the casing wall 15 at the lower right-hand portion thereof. The left-hand edge of the exit opening 72 is defined by a sharp edge between the blower casing wall 15 and an inner wall 51 of the exhaust or transfer passage 73.

The transfer passage 73 is defined by a radially outer wall portion 100 which extends so as to merge as a continuous curve with the cylindrical wall 15 of the blower casing and is formed integrally therewith from the casing parts 16, 17. The radially inner wall 67 of the transfer passage 73 extends generally parallel to the outer wall 100, and the internal cross-sectional area of the passage 73 is substantially constant. A rear wall portion of the transfer passage 73 is formed adjacent the exit opening 72 by the rear casing portion 16 and, further downstream, by front casing portion 17. The rear wall portion of the transfer passage 73 extends initially in a generally circumferential direction, but curves gradually forwardly (i.e. axially) with a large radius of curvature until it is extending substantially axially forwardly relative to the blower, e.g., in a direction substantially parallel to the blower axis A—A. The transfer passage exit is substantially in axial registry with the front ribs 71 of the casing 17. The front wall portion of the transfer passage 73 is short and extends generally parallel to the rear wall portion, so that the cross-sectional area of the passage 73 is not decreased.

All of the walls of the transfer passage 73 are formed generally as smooth curves, with a relatively large radius of curvature. The transfer passage 73 defines a flow path which, from the radially-outward exit opening 72, extends initially in a substantially circumferential direction relative to the cylindrical casing 15 and then also curves forwardly in an axial direction, e.g. in a direction along axis A—A of the blower, cylindrical casing 15 so that the flow direction at the end of the transfer passage 73, is substantially in a forward axial direction and the end of the transfer passage 73 is disposed below and to the right-hand side (viewed rearwardly) of the blower casing cylindrical portion. The flow direction in the transfer passage 73 is generally guided in a smooth curve having a relatively large radius of curvature, without sharp corners. The transfer passage 73 diverts the flow direction through about 80° from its initial generally circumferential direction on exiting the casing. The walls of the transfer passage 73 are formed as integral extensions of parts of the front and rear blower casing portions 17, 16. Generally, the radius of curvature of the flow direction should not be less than about 5 cm at any point in the transfer passage 73.

The outer or lower wall portion 100 of the transfer passage 73 is lined with sound absorbing material, such as, for example, polyurethane foam 18 which occupies between 25% and 50% of the passageway cross-section, and extends as a continuation of the sound absorbing lining 18 around the outer wall 15 of the blower casing.

At the exit opening 72, the outer wall portion 100 comprises a projection 21 which extends through the sound absorbing material to form a hard constriction or throat at the entrance of the transfer passage 73. In manufacture, the size of the projection 21 and hence the area of the throat is selected in dependence upon the power of the electric blower. The throat does not divert the exhaust air flow axial direction through a corner, but provides a hard boundary constriction in a manner which is effective to provide some noise reduction.

The blower casing and walls of the transfer passage 73 are formed of hard plastic material and are mounted in the vacuum cleaner body through damping rubber annuli 68, 69 at the rear and front, to reduce vibration transmission from the blower to the body 1. Furthermore, the blower is itself mounted inside the blower casing through front and rear rubber damping members 36, 37 to inhibit further the transmission of vibrations.

Figure 5:
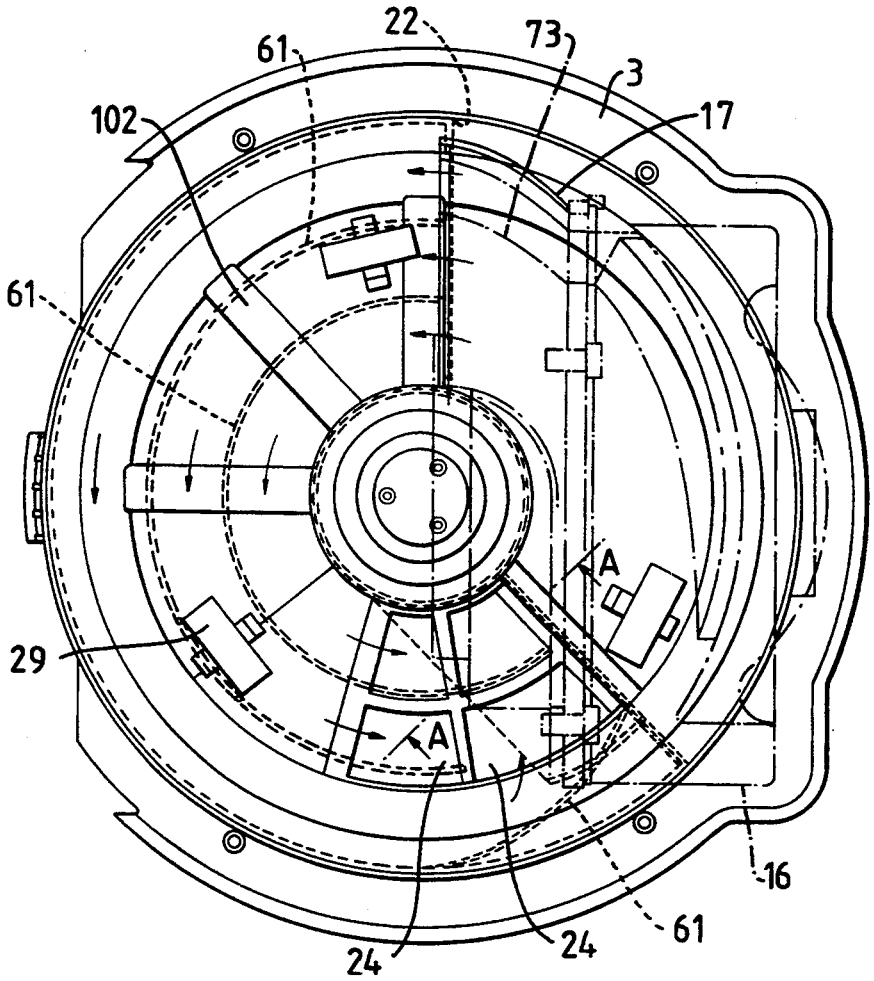
FIG. 5 is a bottom view of the vacuum cleaner body of the present invention.

The end of the exhaust transfer passage 73 opens substantially horizontally into a noise reduction chamber 19 which is formed generally in a ring shape in the bottom of the lower body portion 3, around the pivot housing for the caster base mounting. The noise reduction chamber or space 19 has a generally flat horizontal top wall 22 of rigid plastic and defines a substantially C-shaped expansion space extending for about 200° in a generally flattened shape in the bottom of the body portion 3. The top wall 22 of the chamber or space 19 is in vertical registry with the top wall of the exhaust transfer passage 73 as the transfer passage 73 leads into chamber or space 19, and the passage 73 is of substantially the same vertical depth as the chamber or space 19. Furthermore, the chamber or space 19 has a layer or member 20 of sound absorbing foam, like that in the blower casing and of substantially the same thickness, forming a lower surface thereof. The sound absorbing layer or member 20 is supported on radially extending floor spokes 102 (FIG. 5) at a little distance above the body portion 3, so as to allow some circulation of air below the sound absorbing member. A plurality of, for example, two, arcuate guide ribs 61 extend vertically downwardly from the top wall 22 to the sound absorbing lower layer or member 20 and are curved in a circular arc around the C-shaped chamber or space 19 from the opening of the transfer passage 73 through about 200° to a downwardly opening exit or exhaust aperture 24 through the bottom of the lower body portion 3. Consequently the space 19 contains three partially-annular concentric channels, with each channel having, as a top wall, the top wall 22, as a bottom wall, the sound absorbing layer or member 20, and, as side walls, either two of the ribs 61, or a rib 61 and a wall of the body portion 3. Each of these concentric channels leads from the transfer passage around the bottom of the vacuum cleaner body to the exhaust or exit aperture 24 in the bottom of the body. As shown in FIG. 6, at the exit or exhaust aperture 24, the upper wall of the space 22 curves down smoothly in a guide portion 74 having a large radius of curvature. The downwardly directed exhaust or exit aperture 24 is covered with a metal wire mesh 75 (not shown in FIG. 5) for smoothing turbulences in the exhaust flow passing through the exit or exhaust aperture 24 into the exhaust space 30 defined between the bottom of the body portion 3 and the upper surface of the caster base 4.

Reference is made to the arrows in the drawings for the air flow in the vacuum cleaner of the present invention. In the usual way, air flow suctioned in through the hose by the operation of the blower 7 passes through the dust collecting chamber 9, filtered by the filter bag 5 and further filtered by the micro-filter 33. The air then passes into the electric blower 7 and out through the tail pipes 38 of the blower. The tail pipes 38 guide the flow either forwardly or outwardly, according to the design, over the two 90° segments of the blower circumference as seen in FIG. 2. The air then passes out through the sound-absorbing cover 77 and into the space 8 between the blower cover 77 and the sound-absorbing lining 18 of the blower casing. As shown in FIG. 2, the exhaust air must escape radially outwardly from the casing through exit opening 72, while to the left of exit opening 72 the blower compartment or air circulation space 8 is partially obstructed by the inturned sound absorbing member 18. Accordingly, a swirling flow is established in the clockwise direction as shown in FIG. 2, whereby the exhaust air must circulate around blower compartment or the air circulation space 8 towards the exit opening 72 during which course noise is absorbed by the sound-absorbing layer 18 in the casing. However, a certain proportion of air from one tail pipe 38 can escape in a counterclockwise direction into the exit opening, as shown in FIG. 2. This is important if the electric blower has a high performance. If the exhaust flow swirling in the exhaust casing is too fast, the flow will concentrate excessively at the outside of the space 8 in the casing and noise absorption potential of the sound absorbing members 18, 77 will be reduced. However, the overall exhaust flow velocity in the casing can be reduced if a portion, e.g. 10 to 20%, of the exhaust flow is allowed to pass directly (counterclockwise) into the exit opening 72 as shown in FIG. 2. Alternatively, if the blower 7 is very powerful, the overall exhaust velocity can be reduced by enlarging the blower chamber. This is undesirable if, as is commonly the case, there is only restricted space inside the cleaner body 1, and it is undesirable to enlarge the body cleaner. Accordingly, during manufacturing, it is necessary to consider the performance of the intended blower 7 and to configure the inside of the blower casing and its lining 18 so as to obtain if necessary a proportion of direct (non-swirled) or reverse flow into the transfer passage 73.

Passing into the transfer passage 73, the air flow goes through the throttle caused by the projection 21 and this serves to reduce some noise. Passing along the transfer passage 73, noise is further reduced by passing over the sound absorbing lining 18 therein. Furthermore, since the flow does not run up against opposing surfaces in the transfer passage 73 or at the exit from the blower casing, generation of undesirable noise is avoided.

The double-curved configuration of the transfer passage 73 brings the air flow conveniently down into the lower horizontal plane of the annular noise reduction space 19, into which the air flow can pass still without negotiating any sharp radius. In the noise reduction chamber or space 19, the flow is guided around the C-shape channels, being prevented by the ribs 61 from concentrating at the outside of the annular space. Accordingly, good use is made of the sound absorbing layer 20 over the full extent of the noise reduction chamber or space 19. Reaching the vent aperture 24, the air flow is guided down smoothly by the guide portion 74, smoothed by the wire net 75 and passes into the exhaust space 30 between body and castor base. At this point the flow does undergo a sharp change in direction, since it meets the caster base surface substantially perpendicularly. However, by this point the potentially noise-generating energy of the exhaust air has been largely dissipated by the passage through the blower compartment or air circulation space 8, the transfer passage 73 and the noise reduction chamber or space 19. Also, the vent aperture 24 is made large so that the vent velocity of the exhaust air is low and noise generation by collision with the caster base 4 is not significant. The vented air is then dispersed around the wide and flat exhaust space 30 and can escape in all directions through the narrow slot opening or aperture 76 at the periphery of the castor base. Accordingly, not only is a large exhaust area provided by the slot opening or aperture 76, but also the escape flow has no particular direction. This further reduces the impression of noise emanating from the vacuum cleaner. Because the final exit from the vacuum cleaner is not downward, the exhaust flow does not blow up dust form the floor.

It will be appreciated that, in the vacuum cleaner described above, a highly advantageous noise-reducing effect is achieved with good economy of space, by passing the exhaust flow from the blower casing in a non-radial flow direction, specifically, a circumferential flow direction, along a gradually curved transfer passage and into a noise reduction space including a sound absorbing member and in which throughout the air flow is not subject to sudden turning of angles before it reaches the exhaust or exit aperture 24.

We claim:

1. A vacuum cleaner comprising:

a main body;

a rigid blower casing disposed in said main body;

an electric blower having a blower axis and being mounted in said blower casing and defining a blower casing space extending in axial and radial directions with respect to said blower axis between said blower and said blower casing for passage of exhaust air from said blower; and an exhaust transfer passage in said main body, said exhaust transfer passage communicating with an outwardly-directed exit opening of said blower casing, and wherein said blower casing space opens gradually radially outwardly to said exit opening and wherein said exhaust transfer passage defines a gradually longitudinally curved exhaust flow path which curves from said exit opening away from said blower with a substantial non-radial directional component.

2. A vacuum cleaner as claimed in claim 1, wherein said transfer passage defines said exhaust flow path which extends initially away from said exit opening with a continuous curve to the circumferential direction relative to the axial direction of said electric blower.

3. A vacuum cleaner as claimed in claim 1, wherein the curved flow direction defined by said transfer passage curves towards the axial direction from said exit opening.

4. A vacuum cleaner as claimed in claim 1, comprising a lining of sound absorbent material in said blower casing.

5. A vacuum cleaner as claimed in claim 1, comprising a lining of sound absorbent material in said exhaust transfer passage.

6. A vacuum cleaner comprising:

a main body;

a rigid blower casing disposed in said main body;

an electric blower having a blower axis and being mounted in said blower casing with said blower axis extending in a direction from a front to a rear of said blower casing, and said blower defining a blower casing space extending in axial and radial directions with respect to said blower axis between said blower and said blower casing for passage of exhaust air from said blower; and an exhaust transfer passage in said main body, said exhaust transfer passage communicating with an outwardly-directed exit opening of said blower casing, and defining a curved transfer flow path direction extending away from said blower casing and curving away from an outward radial direction relative to said blower, and wherein said blower casing and said transfer passage comprise a front blower casing part and a rear blower casing part which together form a continuous curve beyond said exit opening.

7. A vacuum cleaner as claimed in claim 1 wherein a cross-sectional area of said exhaust transfer passage substantially constant downstream of said exit opening is not reduced, relative to said flow direction.

8. A vacuum cleaner as claimed in claim 1, wherein said transfer passage comprises walls formed integrally with said blower casing.

9. A vacuum cleaner as claimed in claim 1, wherein said blower casing comprises a front blower casing part and a rear blower casing part, said front and rear parts being fitted together to define said blower casing space.

10. A vacuum cleaner as claimed in claim 1, further comprising means defining a noise reduction space in said main body and means for guiding exhaust air in a curved flow path in said noise reduction space, said noise reduction space communicating with said blower casing space by way of said exhaust transfer passage.

11. A vacuum cleaner as claimed in claim 10 wherein said noise reduction space is an arc-shaped structure.

12. A vacuum cleaner comprising:

a rigid main body having a top and a bottom;

a rigid blower casing disposed in said rigid main body;

an electric blower having a blower axis and being mounted in said blower casing;

said blower casing defining a blower casing space extending in axial and radial directions with respect to said blower axis between said blower and said blower casing for enabling a passage of exhaust air from said blower;

an exhaust transfer passage in said rigid main body, said exhaust transfer passage communicating with an outwardly directed exit opening of said blower casing, said blower casing space opening gradually radially outwardly to said exit opening and said exhaust transfer passage defining a gradually longitudinally curved exhaust flow path which curves from said exit opening away from said blower with a substantial non-radial directional component;

means for defining an exhaust noise reduction space situated in said rigid main body, at least one guide means having an arcuate structure and located within said noise reduction space for guiding exhaust air flow, and a downwardly-opening vent from said noise reduction space to an exterior of said rigid main body; and wherein said exhaust transfer passage is a curved transfer passage communicating between said exit opening of said blower casing space and said noise reduction space, whereby, in use, exhaust air from said blower flows around said blower in said blower casing space, along said curved transfer passage, arcuately in said noise reduction space and out through said downwardly-opening vent to an exterior of said rigid main body.

13. A vacuum cleaner comprising:

a rigid main body having a top and a bottom;

a blower casing disposed in said rigid main body, said casing defining a blower casing space;

an electric blower mounted in said blower casing space:

means for defining an exhaust noise reduction space situated in said rigid main body, at least one guide means having an arcuate structure and located within said noise reduction space for guiding exhaust air flow, and a downwardly-opening vent from said noise reduction space to an exterior of said rigid main body;

a curved transfer passage communicating between said blower casing space and said noise reduction space, whereby, in use, exhaust air from said blower flows around said blower in said blower casing space, along said curved transfer passage, arcuately in said noise reduction space and out through said downwardly-opening vent to the exterior of said rigid main body;

a runner base; and means spacing said runner base below a bottom of said rigid main body for defining a peripheral gap around said vacuum cleaner between said runner base and said rigid main body for enabling an escape of air vented from said noise reduction space.

14. A vacuum cleaner as claimed in claim 12, wherein a regulating throat is formed at an entrance to said exhaust transfer passage.

15. In a vacuum cleaner comprising a main body and a blower mounted within said main body, a noise-reducing air exhaust pathway leading from said blower to an exterior vent of said main body, wherein the vacuum cleaner comprises:

a blower casing surrounding said blower and defining a casing space between said blower and said casing, said casing including means for rotating in a circumferential direction an exhaust air flow from said blower in said casing space, and an exhaust transfer passage having a curved structure for communicating with said blower casing space, said passage defining a curved exhaust flow path having both a circumferential component in the same direction as the rotation in said blower casing, and an axial component relative to said blower, said exhaust transfer passage communicating with an outwardly-directed exit opening of said blower casing, said blower casing space opening gradually radially outwardly to said exit opening and said exhaust transfer passage defining a gradually longitudinally curved exhaust path which curved from said exit opening away from said blower with a substantial non-radial directional component.

16. A vacuum cleaner as claimed in claim 15, wherein said noise-reducing air exhaust pathway further comprises:

means defining a noise reduction space having a passage having a cross-section including an upper flat portion and a lower flat portion downstream of said exhaust transfer passage, the upper flat portion and the lower flat portion of said noise reduction space being substantially parallel with said flow direction of said transfer passage, a noise absorbent surface within said noise reduction space, and at least one curved guide means in said noise reduction space for guiding exhaust airflow from said transfer passage in a curved path over said noise absorbent surface.

* * * * *